US006402667B1

(12) United States Patent
Dahn

(10) Patent No.: US 6,402,667 B1
(45) Date of Patent: Jun. 11, 2002

(54) ISOKINETIC EXERCISE APPARATUS FOR THE LOWER BODY

(76) Inventor: Wade R. Dahn, 1803 Oakmont, Cedar Park, TX (US) 78613

( * ) Notice: Subject to any disclaimer, the term of this patent is extended or adjusted under 35 U.S.C. 154(b) by 0 days.

(21) Appl. No.: 09/228,461

(22) Filed: Jan. 11, 1999

(51) Int. Cl.[7] ..... A63B 21/02
(52) U.S. Cl. ..... 482/121; 482/122; 482/123
(58) Field of Search ..... 482/53, 73, 87, 482/111, 112, 114, 121–125, 129, 131, 23, 34

(56) References Cited

U.S. PATENT DOCUMENTS

| | | | | |
|---|---|---|---|---|
| 118,740 A | | 9/1871 | O'Connor | |
| 552,971 A | | 1/1896 | Sandow | |
| D209,759 S | | 1/1968 | Snyder | |
| 3,451,271 A | | 6/1969 | Knoblauch | |
| 3,784,195 A | | 1/1974 | Johnson | |
| 3,985,354 A | | 10/1976 | Schulkin | |
| 4,351,527 A | | 9/1982 | Crisp | |
| 4,371,162 A | | 2/1983 | Hartzell | |
| 4,395,039 A | * | 7/1983 | Kaiser | 482/131 |
| 4,592,545 A | * | 6/1986 | Sagedahl et al. | 482/7 |
| 4,632,393 A | * | 12/1986 | Noord | 482/133 |
| 4,699,376 A | * | 10/1987 | Mattox et al. | 482/114 |
| D299,843 S | | 2/1989 | Brentham | |
| 4,863,163 A | | 9/1989 | Wehrell | |
| 5,069,448 A | * | 12/1991 | Shyu | 482/130 |
| 5,154,685 A | | 10/1992 | Chen | |
| 5,181,895 A | * | 1/1993 | Larson et al. | 482/93 |
| 5,215,508 A | * | 6/1993 | Bastow | 482/79 |
| 5,476,435 A | | 12/1995 | Nimmo | |
| 5,501,646 A | * | 3/1996 | Miller | 482/111 |
| 5,512,029 A | | 4/1996 | Barnard | |
| 5,551,934 A | | 9/1996 | Binette | |

FOREIGN PATENT DOCUMENTS

| | | |
|---|---|---|
| CA | 1176669 | 10/1984 |

* cited by examiner

*Primary Examiner*—Michael A. Brown
*Assistant Examiner*—Lori Baker Amerson
(74) *Attorney, Agent, or Firm*—Russell D. Culbertson; Shaffer & Culbertson, LLP

(57) ABSTRACT

An exercise device (10) includes a base (11) comprising a rigid piece of material which may be placed flat on a floor. An isokinetic resistance unit (12) is pivotally connected at a lower end to the base, with a harness (13) connected to an upper end of the resistance unit. A user uses the device by attaching the harness (13) preferably around the waist and, while standing on the base (11), bending to a squatting position and then returning to an upright position. The resistance unit (12) comprises a cylinder (30) and piston (31) arrangement which provides resistance as the user moves from the squatting position to the upright position. The resistance is provided through a negative pressure developed in a working chamber (38) defined between the piston (31) and a first end of the cylinder (30).

6 Claims, 4 Drawing Sheets

ISOKINETIC EXERCISE APPARATUS FOR THE LOWER BODY

TECHNICAL FIELD OF THE INVENTION

This invention relates to exercise devices and, more particularly, to an isokinetic exercise apparatus for exercising the legs and lower body.

BACKGROUND OF THE INVENTION

Numerous types of devices have been developed for exercising various muscles or muscle groups. Exercise devices generally provide some sort of resistance to the user's movement. For example, the resistance may be provided by weights, elastic elements such as springs, or pneumatic or hydraulic devices. Exercise machines which use weights to provide resistance are commonly bulky and not easily portable. Elastic elements generally provided resistance which varies as the elastic element is deformed. Also, elastic elements can wear out over extended use. Pneumatic and hydraulic resistance devices can provide a resistance which varies in proportion to the force applied by the user. Exercise in which the resistance is proportional to the force applied by the user is referred to as "isokinetic" exercise. Prior isokinetic exerciser devices for exercising the legs and lower body were free standing bulky devices which were not readily portable.

SUMMARY OF THE INVENTION

It is an object of the invention to provide an easily portable and lightweight isokinetic exercise apparatus for exercising the legs and lower body.

The exercise apparatus according to invention includes a substantially rigid base and an isokinetic resistance unit mounted thereon. The isokinetic resistance unit is connected to the base by a pivot connection which allows the resistance unit to pivot about an axis parallel to a base axis. The base has two support areas spaced apart along the base axis, one support area on each side of the point at which the resistance unit is connected to the base. The apparatus further includes a harness or belt which is connected to an upper end of the resistance unit.

The isokinetic resistance unit relies upon a fluid, preferably air, for providing resistance. Also, the preferred resistance unit utilizes a negative pressure to provide resistance rather than a positive pressure. By utilizing negative pressure, the resistance unit according to the invention simplifies the required sealing arrangements.

The preferred resistance unit comprises a cylinder with a piston slidably received therein. A rod is connected to the piston and extends generally parallel and coaxially with the cylinder. The rod and piston are adapted to move with respect to the cylinder between a retracted position and an extended position. In the retracted position, the piston resides near a sealed lower end of the cylinder and the rod extends a relatively short distance beyond the opposite end of the cylinder. However, when the piston slides to the extended position in an upper end of the cylinder, the rod extends substantially beyond the upper end of the cylinder. The area of the cylinder defined between the piston and lower end of the cylinder forms a working chamber. The resistance unit also includes an air flow resistance opening and a one-way valve associated with the working chamber. A return spring may act between the piston and cylinder to bias the piston toward the lower end of the cylinder.

In operation, the user stands on the base and pulls the rod and piston to the extended position to allow the belt to be connected around the user's waist. With the belt fixed around the user's waist, the user bends their legs while keeping their back substantially perpendicular to the base and floor, and then completes the repetition by straightening their legs to return to the starting position. The rod and piston in the resistance unit move toward the retracted position as the user bends their legs, and then move toward the extended position as the user straightens their legs. However, the isokinetic resistance unit resists the movement toward the extended position, applying a resisting force through the rod and belt positioned around the user's waist. The resistance is generated by the negative pressure produced in the working chamber portion of the cylinder as the piston moves toward the extended position. The air flow resistance opening limits air flow into the working chamber, preventing the pressure in the working chamber from quickly equalizing with ambient pressure and maintaining the negative working chamber pressure as the user pulls the piston and rod toward the extended position.

The apparatus according to the invention provides good exercise for the lower body and particularly the legs. Yet the device is lightweight, easily portable, and may be stored easily. The use of negative pressure in the working chamber to provide resistance also simplifies the sealing arrangement required in the device. In particular, a sliding seal is required only between the piston and the cylinder.

These and other objects, advantages, and features of the invention will be apparent from the following description of the preferred embodiments, considered along with the accompanying drawings.

DESCRIPTION OF THE PREFERRED EMBODIMENTS

Figure 1:
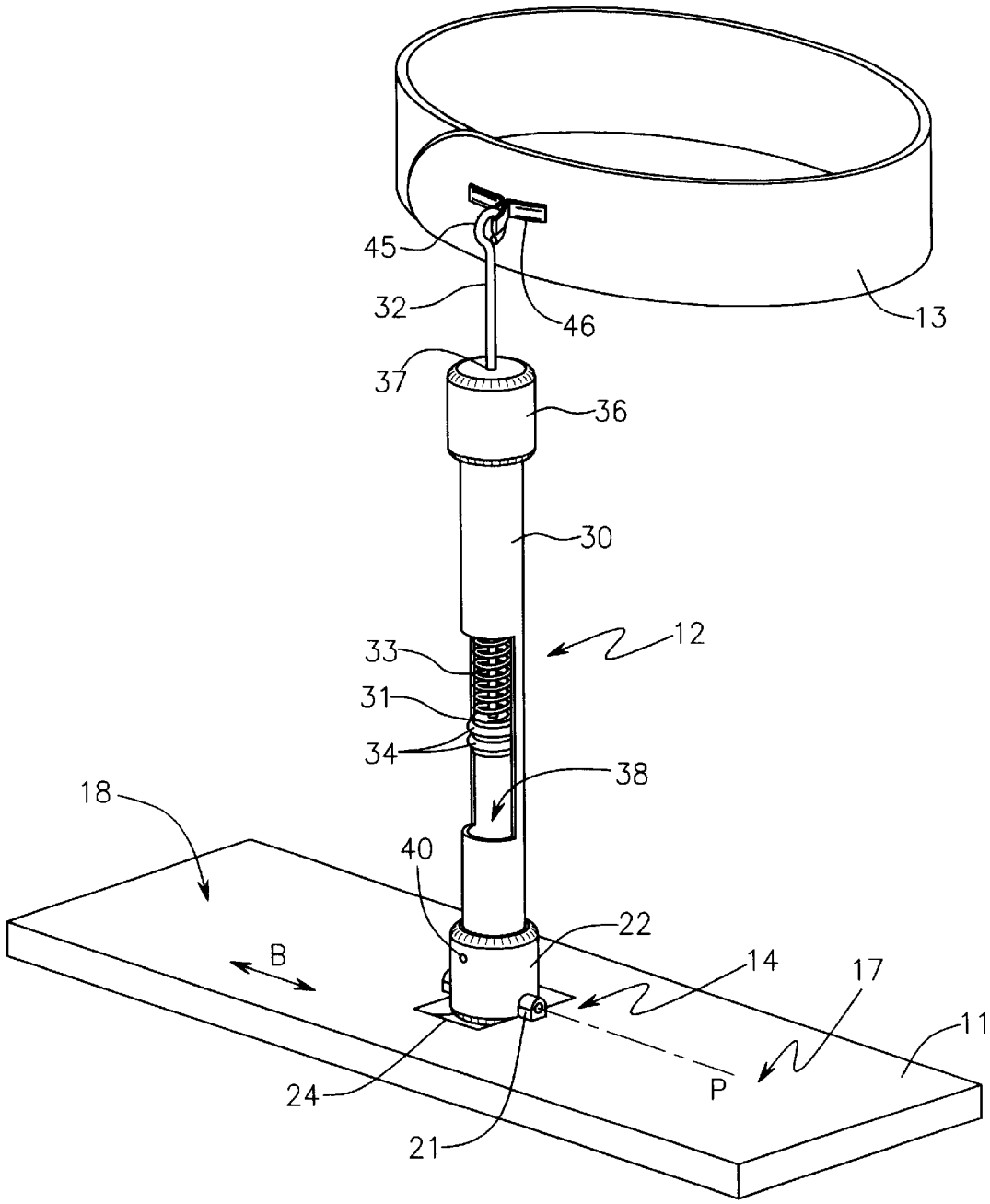
FIG. 1 is an isometric drawing of an exercise apparatus embodying the principles of the invention, with the resistance unit partially cut away to show the inner components.
Figure 2:
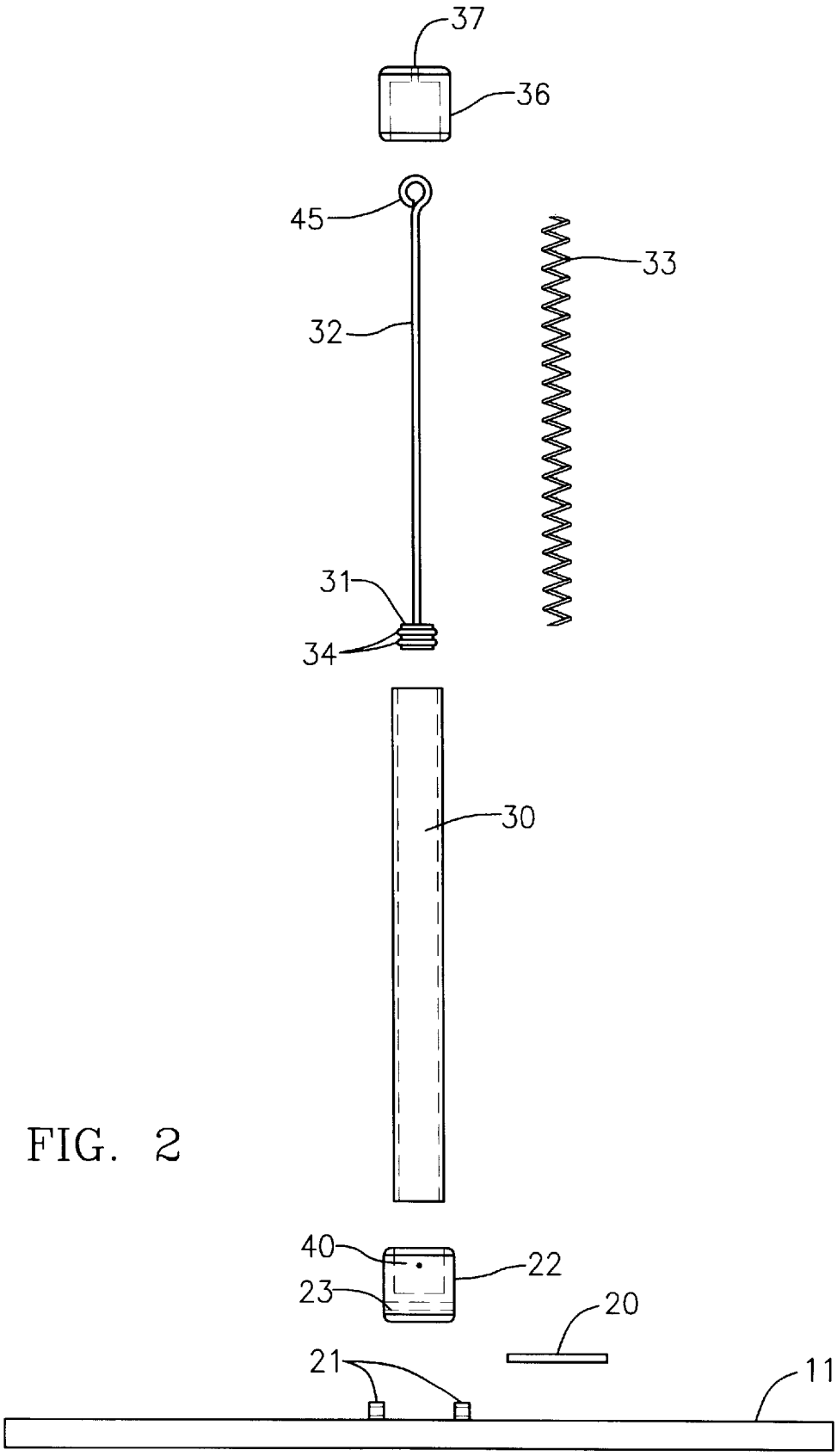
FIG. 2 is an exploded side view of the base and resistance unit.

Referring to FIGS. 1 and 2, an exercise apparatus 10 according to the invention comprises a base 11, isokinetic resistance unit 12, and belt 13. The resistance unit 12 is connected at a lower end to base 11 by a lower pivot connection shown generally at reference numeral 14. Belt 13 is connected to the end of the resistance unit 12 opposite the end connected to base 11.

Base 11 comprises a piece of substantially rigid material having a bottom surface which allows the base to be placed flat on a floor. The upper surface of base 11 includes a first support area 17 and a second support area 18 spaced apart along a base axis B. Resistance unit 12 is connected to base 11 at a location between the first and second support areas, 17 and 18, respectively.

Figure 3:
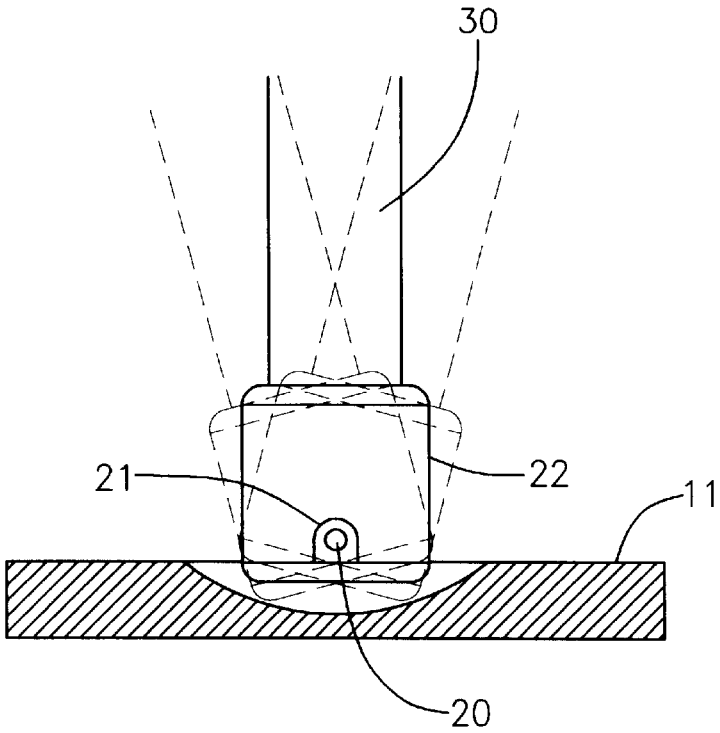
FIG. 3 is a side view showing the connection between the resistance unit and base.

Referring now to FIG. 3 in addition to FIGS. 1 and 2, pivot connection 14 between resistance unit 12 and base 11 allows the resistance unit to pivot about an axis P which extends substantially parallel to base axis B. The illustrated pivot arrangement 14 includes a cylindrical pin 20 supported at both ends by projections 21 extending from base 11. The cylindrical pin 20 extends through a pin receiving opening 23 through a lower end cap 22 positioned at a lower end of the resistance unit 12. The illustrated base 11 may also include an indentation 24 which accommodates the lowermost end of resistance unit 12 and allows the resistance unit to pivot freely about axis P. Indentation 24 may be omitted by lengthening the projections 21 sufficiently to provide the required clearance between base 11 and the lowermost end of resistance unit 12.

Resistance unit 12 includes a cylinder 30 and a piston 31. A rod 32 is connected to piston 31 and extends substantially parallel to cylinder 30 through an opening 37 in an upper end cap 36. The preferred form of the invention also includes a return spring 33. O-rings 34 provide a seal between piston 31 and the inner wall of cylinder 30. Although the O-ring sealing arrangement is preferred, those skilled in the art will appreciate that the apparatus 10 may use any sealing arrangement which provides a good sliding seal between piston 31 and cylinder 30. It will be noted that no seal is needed between the opening 37 and rod 32 in the illustrated form of invention. End cap 36 and opening 37 serve to support rod 32 in the desired position generally parallel to cylinder 30.

Piston 31 and rod 32 are adapted to slide with respect to cylinder 30 between a retracted position and an extended position. In the retracted position, piston 31 resides relatively near end cap 22 and rod 32 extends the length of the cylinder and out the upper end cap 36 for a relatively short distance. In the extended position, piston 31 is relatively nearer upper end cap 36 and rod 32 extends relatively further out of the upper end cap. In either the retracted or extended position, the area of cylinder 30 defined between piston 31 and lower end cap 22 comprises a working chamber, referred to generally in the drawings at reference numeral 38.

Figure 4:
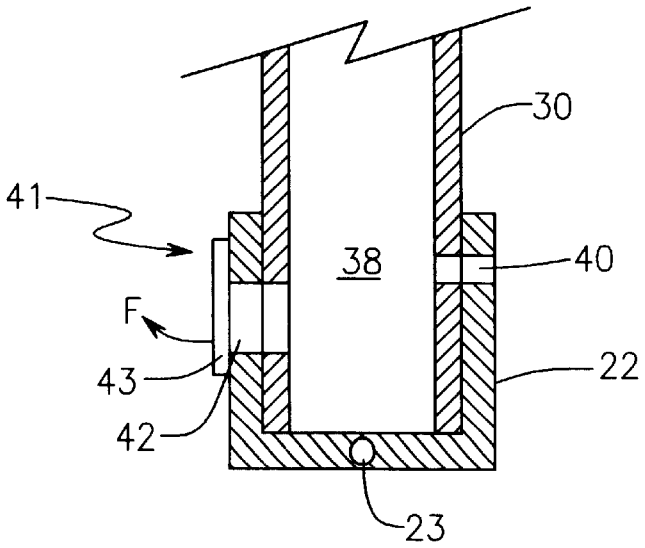
FIG. 4 is a side view showing a lower portion of the resistance unit.
Figure 5:
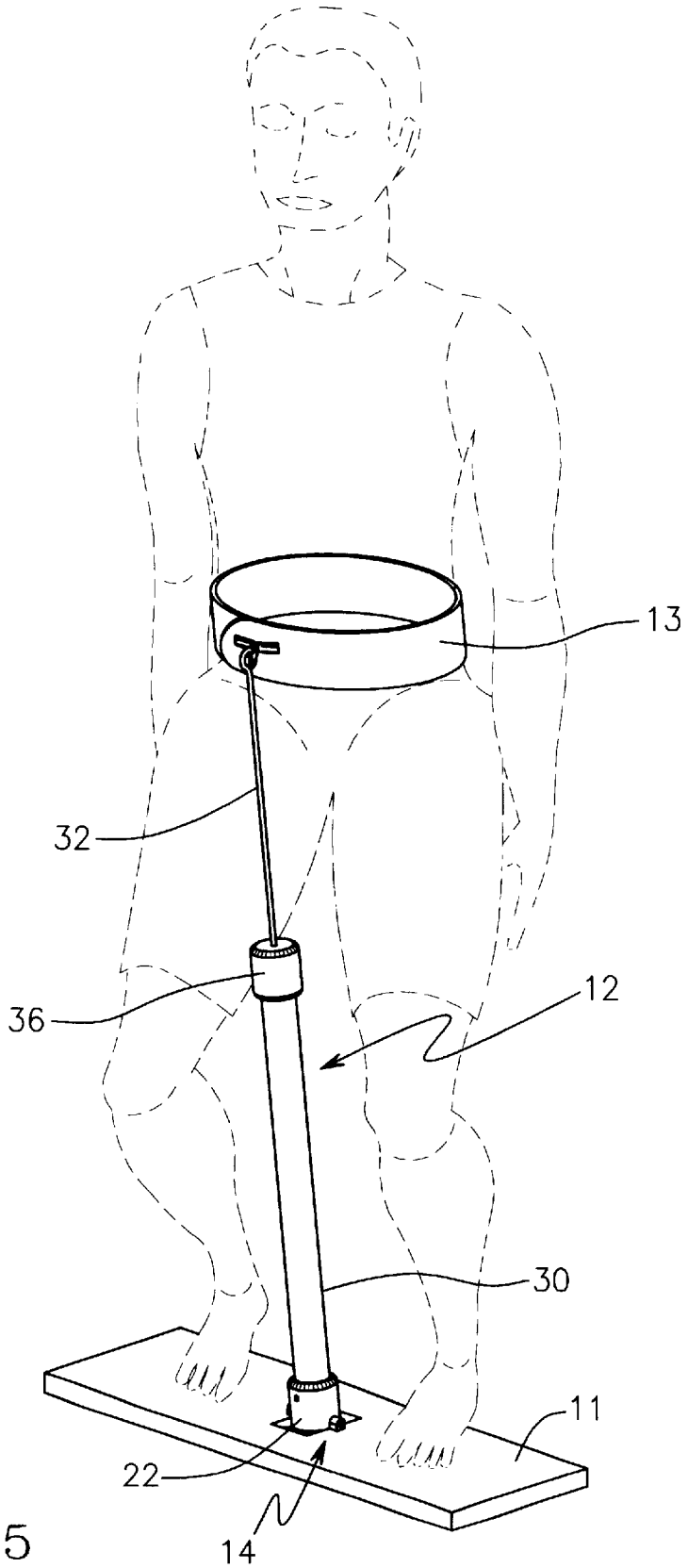
FIG. 5 is an isometric drawing illustrating the use of the exercise device shown in FIG. 1.

As shown best in FIG. 4, an air flow resistance opening 40 and a one-way valve 41 are associated with the working chamber portion 38 of cylinder 30. One-way valve 41 includes an opening 42 into the working chamber 38 with a flap of material 43 extending over the opening on the side of the opening external to the working chamber. Flap 43 may pivot outwardly in direction of arrow F. Air flow resistance opening 40 comprises a small opening into working chamber 38. Although not shown in the drawings, a valve may be associated with air flow resistance opening 40 for adjusting the effective area of the opening.

The end of rod 32 opposite the end connected to piston 31 includes a suitable connector for connecting to belt 13. The preferred connection allows the belt 13 to pivot at least somewhat with respect to rod 32 and may, for example, comprises an eye 45 at the end of the rod and a loop 46 extending from the belt. The illustrated belt 13 comprises a length of material which may be fastened around the user's waist with any suitable closure arrangement, including a Velcro closure or a suitable buckle (not shown). Although not shown in the drawings, shoulder straps which extend over the user's shoulders may be connected to belt 13 to help distribute the force provided by resistance unit 12 during use. Those skilled in the art will appreciate that any suitable harness arrangement may be substituted for the belt-type harness 13 illustrated in the drawings. Such alternative harnesses are to be considered equivalents to the belt 13 for purposes of the following claims.

The operation and use of exercise apparatus 10 may be described with reference primarily to FIG. 4. With the base 11 placed on a floor or other relatively flat surface, the user pulls rod 32 toward the extended position, raising the belt 13 sufficiently to fasten it around their waist. With the belt 13 fastened and the user's feet positioned in the support areas 17 and 18 of base 11, the user begins the exercise by bending their legs while keeping their back straight and substantially perpendicular to the floor. As user bends their legs, their waist moves relatively closer to base 11 and allows rod 32 and piston 31 to move toward the retracted position. Spring 33 may act between upper end cap 36 and piston 31 to help move the piston and rod 32 toward the retracted position. As piston 31 moves toward the retracted position, one-way valve 41 opens so that air may flow from working chamber 38 through opening 42. With the one-way valve open, there is very little resistance to the flow of air out of working chamber 38, and thus little if any resistance to the downward movement of piston 31 and rod 32 with respect to cylinder 30.

After bending their legs to the desired extent, the user completes the repetition by straightening their legs while keeping their back straight and generally perpendicular to the floor. As user straightens their legs, piston 31 and rod 32 move toward the extended position. The upward movement of piston 31 creates a vacuum in working chamber 38 which pulls flap 43 tightly against opening 42 to close one-way valve 41. The vacuum in working chamber 38 also draws in air through air flow resistance opening 40. However, air flow resistance opening 40 is small enough to maintain the negative pressure in working chamber 38 for a period of time as piston 31 moves upwardly. The negative pressure in working chamber 38 resists the upward movement of piston 31. This resistance to upward movement is transferred to the user through rod 32 and belt 13.

Providing resistance through the negative pressure in working chamber 38 according to the invention simplifies the seals which must be used in resistance unit 12. Although a positive pressure between piston 31 and upper end cap 36 could be used to resist the upward movement of the piston, such a resistance arrangement would require not only a sliding seal between the piston and cylinder but also a seal between the end cap opening 37 and rod 32.

The above described preferred embodiments are intended to illustrate the principles of the invention, but not to limit the scope of the invention. Various other embodiments and modifications to these preferred embodiments may be made by those skilled in the art without departing from the scope of the following claims. For example, resistance unit 12 may be connected oppositely to the connection shown in the figures, with rod 32 connected to base 11 and cylinder 30 connected to belt 13. Also, although the end caps 22 and 36 are shown as separate elements, they may be formed integrally with cylinder 30. Where separate end caps are used, they may be connected to the cylinder by any suitable means such as by an adhesive or welding, for example. Furthermore, although air flow resistance opening 40 and one-way valve 41 are associated with end cap 22, these elements may be positioned elsewhere within the scope of the invention. For example, both the one-way valve 41 and air flow resistance opening 40 may be located on the piston 31, with the one-way valve flap 43 on the upper surface of the piston. Also, although spring 33 is preferred for returning piston 31 to the retracted position, the spring may be omitted within the scope of the invention.

What is claimed is:

1. An exercise apparatus for providing resistance as a user straightens their legs to move from a bent-leg standing position to a second standing position, the distance between the level of the user's feet and the user's waist in the second standing position defining a first dimension and the distance between the level of the user's feet and the user's waist in the bent-leg position defining a second dimension, the apparatus comprising:

(a) a substantially rigid base having an upper surface with a first support area and a second support area, the first support area being spaced apart from the second support area along a base axis;

(b) an isokinetic resistance unit providing isokinetic resistance as it moves from a retracted length to an extended length, the extended length being substantially equal to the first dimension and the retracted length being substantially equal to the second dimension;

(c) a lower pivot connection connecting a lower end of the isokinetic resistance unit to the base at a location between the first support area and the second support area, the lower pivot connection having a pivot axis about which the isokinetic resistance unit may pivot; and (d) a waist harness connected to an upper end of the isokinetic resistance unit, the waist harness adapted to extend around the user's waist.

2. The apparatus of claim 1 wherein the isokinetic resistance unit comprises a pneumatic resistance unit.

3. The apparatus of claim 2 wherein the isokinetic resistance unit comprises:

(a) a cylinder having at least one air flow resistance opening associated therewith;

(b) a piston slidably received in the cylinder and providing a substantial seal with the cylinder, the area of the cylinder defined between the piston and a first end of the cylinder comprising a working chamber;

(c) a rod rigidly connected to the piston and extending parallel to the longitudinal axis of the cylinder on a side of the piston opposite to the working chamber; and (d) an air flow resistance opening extending into the working chamber.

4. The apparatus of claim 3 wherein the isokinetic resistance unit further comprises:

(a) a return spring acting between the piston and the cylinder to bias the piston toward a retracted position at the first end of the cylinder.

5. The apparatus of claim 3 further comprising:

(a) a one-way valve associated with the working chamber, the one-way valve allowing air to flow out of the working chamber in response to positive pressure in the working chamber and sealing in response to negative pressure in the working chamber.

6. The apparatus of claim 1 wherein the lower pivot connection comprises:

(a) a cylindrical pin supported at both ends by the base; and (b) a cylindrical pin opening formed in the lower end of the isokinetic resistance unit, the cylindrical pin being received through cylindrical pin opening.

* * * * *